US009685266B2

(12) United States Patent
Downing

(10) Patent No.: US 9,685,266 B2
(45) **Date of Patent: *Jun. 20, 2017**

(54) IMMERSION COOLED INDUCTOR APPARATUS

(71) Applicant: Hamilton Sundstrand Corporation, Windsor Locks, CT (US)

(72) Inventor: Robert Scott Downing, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 567 days.

This patent is subject to a terminal disclaimer.

(21) Appl. No.: 14/182,424

(22) Filed: Feb. 18, 2014

(65) Prior Publication Data

US 2014/0159843 A1 Jun. 12, 2014

Related U.S. Application Data

(63) Continuation of application No. 13/467,957, filed on May 9, 2012, now Pat. No. 8,680,959.

(51) Int. Cl.

| | |
|---|---|
| ***H01F 27/10*** | (2006.01) |
| ***H01F 27/02*** | (2006.01) |
| ***H01F 27/08*** | (2006.01) |
| ***H01F 27/24*** | (2006.01) |
| ***H01F 5/04*** | (2006.01) |
| *H01F 27/40* | (2006.01) |

(52) U.S. Cl.

CPC ..... *H01F 27/10* (2013.01); *H01F 5/04* (2013.01); *H01F 2027/404* (2013.01)

(58) Field of Classification Search

CPC ..... H01F 27/12; H01F 27/18; H01F 27/14; H01F 27/322; H01F 38/30

USPC ..... 336/58, 55, 57, 59, 60

See application file for complete search history.

(56) References Cited

U.S. PATENT DOCUMENTS

| | | | | |
|---|---|---|---|---|
| 4,145,679 | A | 3/1979 | Mitchell, Jr. | |
| 4,321,421 | A * | 3/1982 | Pierce | 174/11 R |
| 4,467,305 | A * | 8/1984 | Ando | 336/55 |
| 4,543,446 | A * | 9/1985 | Foss et al. | 174/11 R |
| 4,609,900 | A * | 9/1986 | Bachhofer | H01F 27/14 174/11 R |
| 5,346,750 | A * | 9/1994 | Hatakeyama et al. | 428/209 |
| 6,144,278 | A * | 11/2000 | Nishida et al. | 336/92 |
| 6,301,127 | B1 * | 10/2001 | Kobayashi | H01F 27/06 336/192 |
| 7,283,378 | B2 | 10/2007 | Clemmons | |
| 7,471,181 | B1 | 12/2008 | MacLennan | |
| 7,473,628 | B2 | 1/2009 | Seto et al. | |
| 7,710,228 | B2 | 5/2010 | Feng et al. | |
| 7,855,629 | B2 | 12/2010 | MacLennan | |
| 7,973,632 | B2 | 7/2011 | MacLennan et al. | |
| 8,009,008 | B2 | 8/2011 | MacLennan | |
| 8,154,372 | B2 | 4/2012 | Feng et al. | |
| 2003/0080841 | A1 | 5/2003 | Nishimizu et al. | |
| 2003/0186020 | A1 * | 10/2003 | Kasahara | 428/95 |
| 2004/0066608 | A1 * | 4/2004 | Takagi et al. | 361/530 |

(Continued)

*Primary Examiner* — Mangtin Lian
*Assistant Examiner* — Kazi Hossain
(74) *Attorney, Agent, or Firm* — Carlson, Gaskey & Olds, P.C.

(57) ABSTRACT

An immersion cooled inductor includes an inductor at least partially submerged in cooling liquid and a localized boiling feature operable to instigate boiling of the cooling liquid prior to oversaturation.

15 Claims, 2 Drawing Sheets

(56) References Cited

U.S. PATENT DOCUMENTS

| | | | |
|---|---|---|---|
| 2007/0080769 | A1 | 4/2007 | Thiel et al. |
| 2011/0140820 | A1 | 6/2011 | Guentert, III et al. |
| 2011/0227681 | A1 | 9/2011 | MacLennan |

* cited by examiner

IMMERSION COOLED INDUCTOR APPARATUS

RELATED APPLICATIONS

This application is a continuation of U.S. patent application No. 13/467957, which was filed May 9, 2012.

BACKGROUND OF THE INVENTION

The present disclosure is directed to inductors, and more specifically to immersion cooled inductors.

It is known in the art that inductors generate large amounts of heat during operation. In order to prevent damage due to overheating, inductors are cooled. One method of cooling an inductor is to immerse the inductor in a dielectric cooling liquid within a hermetically sealed cooling tank. This configuration is referred to as an immersion cooled inductor.

With high heat flux immersion cooling, heat from the inductor causes the dielectric cooling liquid to change states from a liquid to a gas (referred to as boiling). The heated cooling vapor (gas) rises to the top of the hermetically sealed cooling tank and condenses, thereby providing a cooling effect to the inductor. The rising gas is normally in a moving collection of bubbles, but other flow patterns such as annular flow are possible. Most commonly, the vapor is condensed in a heat exchanger which is cooled by another fluid, usually air. In some designs a submerged condenser is used as a part of the vessel side walls and removes heat directly from the liquid.

For boiling to occur on a surface, that surface must be raised above the saturation temperature defined by the vessel pressure. This temperature excess, called "overshoot" can result in thermal damage to the windings or the core. The overshoot is a function of the heat flux and surface condition.

The excess heat involved in bringing the dielectric cooling liquid above the saturation temperature can damage the inductor. Furthermore, when an event (such as vibration) causes the cooling liquid to begin boiling above the saturation temperature, the body of cooling liquid all begins to vaporize almost instantaneously resulting in a violent boiling effect causing a rapid pressurization. The rapid pressurization produces large transient forces that can damage the inductor, the mounting features or containment vessel.

SUMMARY OF THE INVENTION

Disclosed is an immersion cooled inductor having a hermetically sealed immersion tank at least partially filled with a dielectric cooling liquid, a plurality of inductor windings wound around a core, wherein the inductor windings and the core are at least partially submerged within the dielectric cooling liquid, a plurality of leads extending out of the immersion tank, wherein the leads are connected to the inductor windings, and at least one localized boiling feature operable to begin boiling of the dielectric cooling liquid prior to the temperature of the cooling liquid significantly exceeding the saturation temperature of the dielectric cooling liquid.

Also disclosed is a method for cooling an inductor having the steps of: at least partially submerging an inductor in a dielectric cooling liquid within a hermetically sealed tank and instigating boiling within the dielectric cooling liquid using a localized boiling feature, such that the dielectric cooling liquid begins boiling without significantly exceeding a saturation temperature.

These and other features of this application will be best understood from the following specification and drawings, the following of which is a brief description.

DETAILED DESCRIPTION

Figure 1:
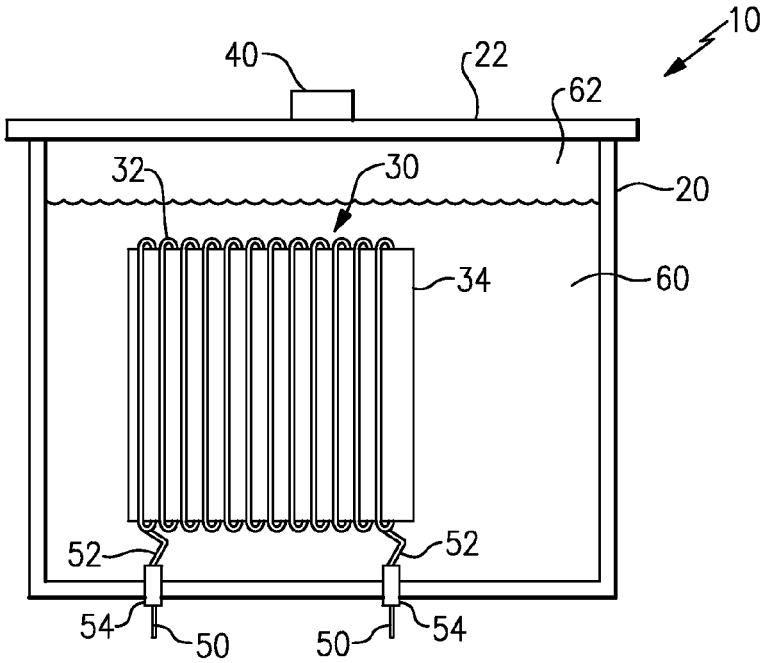
FIG. 1 is a schematic illustration of an immersion cooled inductor system.

FIG. 1 illustrates an immersion cooled inductor system 10. The immersion cooled inductor system 10 has an immersion tank 20 with a hermetically sealed cap 22. The hermetically sealed cap 22 has a port 40 that is utilized to insert a cooling liquid 60 into the immersion cooled inductor system 10 after assembly. Noncondensable gases present in the system are also removed through port 40. Contained within the tank 20 is an inductor 30. The inductor 30 has multiple inductor windings 32 wound around an inductor core 34. The inductor core 34 can be any known core type, such as a toroidal core, an E-type core or a C-type core.

Multiple leads 50 are connected to the inductor windings 32 via connector pins 54 and a localized boiling feature 52. The leads 50 provide power inputs and outputs to the inductor 30. In the example of FIG. 1, a single phase inductor is illustrated, resulting in a single pair of input and output leads 50. In the case that a multiphase inductor is utilized, each phase of the inductor will have a pair of input and output leads 50.

The tank 20 includes a vapor portion 62 above the dielectric cooling liquid 60. For an overhead condenser, the vapor portion 62 is in contact with a condenser that is integrated with the cap 22 or on other walls of the vessel. The vapor space provides a condensing area where heated vapors condense and return to the dielectric cooling liquid 60. The dielectric cooling liquid 60 cools the inductor through the state change of the cooling liquid 60 to a gas. While the example illustrated in FIG. 1 illustrates the inductor 30 completely submerged in the dielectric cooling liquid 60, it should be understood that a partially submerged inductor 30 configuration could also be used. By way of example a ¾ submerged or ½ submerged inductor 30 can be used. In these alternate examples, the portion of the inductor 30 that is not submerged extends into the vapor portion 62.

Under normal conditions, when the dielectric cooling liquid 60 is heated to a certain temperature excess above the saturation point, the dielectric cooling liquid 60 begins to boil. The conversion of the dielectric cooling liquid 60 into a vapor absorbs heat energy from the inductor 30. The vapors then rise (normally in the form of bubbles) to the top of the cooling tank 20 into the vapor portion 62. The vapors in the vapor portion 62 condense and return as cooling liquid 60. The process of converting to a vapor and then back into a liquid removes energy from the system thereby cooling the inductor 30. The choice of the dielectric fluid and the condenser temperature dictate the pressure level at which a hermetically sealed tank 20 operates. In steady operation, the dielectric liquid is under saturation conditions and the conductors surfaces are slightly hotter to support boiling. However, a transient condition can occur during startup where the heating surfaces reach temperatures beyond the normal boiling values and the fluid is significantly above the saturation temperature for that pressure. That is to say, the temperature of the fluid exceeds the boiling temperature at that pressure by more than a marginal amount. This condition is referred to as over saturation.

Each of the leads 50 are connected to the inductor windings 32 via a localized boiling feature 52 and a connector pin 54. In systems constructed without the localized boiling feature 52, the dielectric cooling liquid 60 temperature can over saturate the cooling liquid 60. In such a case, the initial boiling event is violent and can damage the inductor 30, its support structure or containment vessel due to sudden, possibly unbalanced, pressure forces, or the resultant vibration as all of the cooling liquid 60 attempts to vaporize almost instantaneously.

In order to prevent over saturation and violent boiling, localized boiling features 52 are included below the inductor 30. In alternate examples, localized boiling features 52 can be intermixed with the inductor windings 32, depending on the specific type of localized boiling feature 52 used. The illustrated localized boiling features 52 of FIG. 1 are a localized reduction in the cross sectional area. The reduced cross-sectional area has a greater electrical resistance which causes a higher heat generation rate and heat flux. The increased heat generation rate in turn causes an increase in the localized heat flux promoting incipit boiling at the localized boiling feature 52 to be higher than at the inductor windings 32. The higher heat generation causes that surface area of the localized boiling feature 52 to rise in temperature faster than other elements, and the cooling liquid 60 around the localized boiling feature 52 to begin boiling before than the cooling liquid 60 around the inductor 30. Since the localized boiling features 52 are located below the inductor windings 32 of the inductor 30, boiling started at the localized boiling features 52 propagates upwards and triggers the boiling process at the surfaces of the inductor coil wetted by the coolant 60 before the temperature of the cooling liquid 60 exceeds the saturation point, thereby avoiding significant superheating of the cooling liquid 60.

Figure 2A:
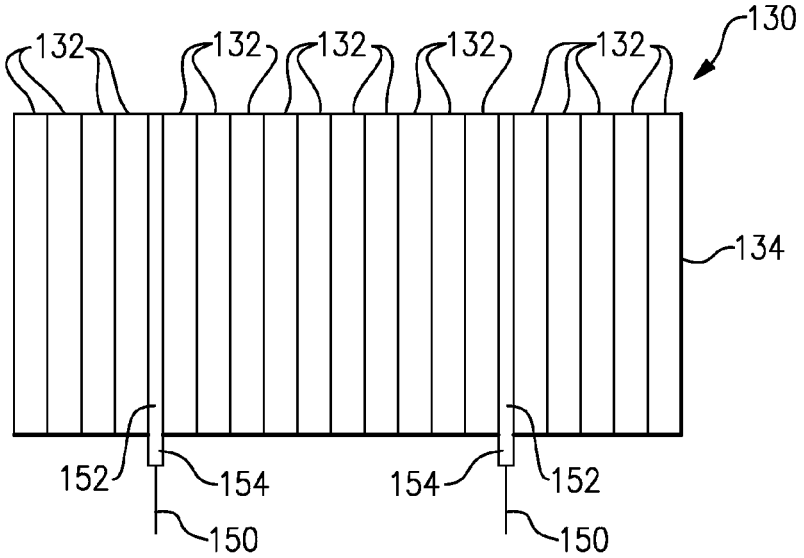
FIG. 2A is a schematic illustration of an inductor for use in an immersion cooled inductor system.
Figure 2B:
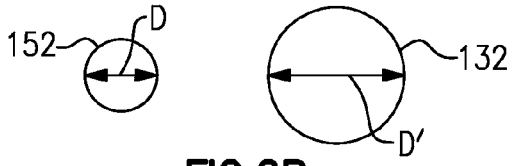
FIG. 2B is a cross-sectional view of inductor windings of the inductor of FIG. 2A.

An alternate to the "necked down" region of higher heat generation as a localized boiling feature 52 of FIG. 1 can be constructed on the leads of the inductor 30. FIG. 2A is a schematic illustration of an inductor portion of the immersion cooled inductor system of FIG. 1 incorporating the alternate localized boiling winding 152. FIG. 2B illustrates a cross sectional view of inductor windings 132 and localized boiling windings 152 of FIG. 2A.

The inductor 130 includes a core 134 about which inductor windings 132, 152 are wound. Each of the leads 150 is connected to a localized boiling winding 152 via a connector pin 154. Each of the localized boiling windings 152 also function as inductor windings. As can be seen in the two cross-sectional views of FIG. 2B, the cross sectional diameter D of the localized boiling winding 152 is smaller than the cross sectional diameter D' of the standard inductor winding 132. The smaller cross-section results in a higher resistance along the localized boiling winding 152 than along the standard inductor winding 132. As described above with regards to FIG. 1, a higher resistance increases the heat generation per unit length and thereby the heat flux at the localized boiling winding 152 surface and thereby causes the cooling liquid 60 immediately adjacent to the localized boiling winding 152 to begin boiling before the general temperature of the cooling liquid 60 significantly exceeds the saturation temperature. The localized boiling windings 152 are arranged such that the boiling reaction spreads from the localized boiling windings 152 to the remainder of the cooling liquid 60, thereby instigating boiling throughout the cooling liquid 60.

The particular diameters D and D' of the windings 132, 152 are exaggerated for illustrative effect and can be determined by one of skill in the art according to known principles for any particular application. The particular location of the localized boiling winding 152 relative to the locations of the standard inductor windings 132 can be determined by one of skill in the art.

In the example inductor 130 of FIG. 2A, the inductor windings 132 and the localized boiling winding 152 can be any known type of inductor wire such as a standard single wire configuration or a litz wire configuration. It is difficult to hermetically seal certain types of wires, such as litz wires, across the walls of the tank 20 to the leads 50. To facilitate these types of wires, a connector pin passing through the housing of the hermetically sealed tank 20 is utilized.

Figure 3A:
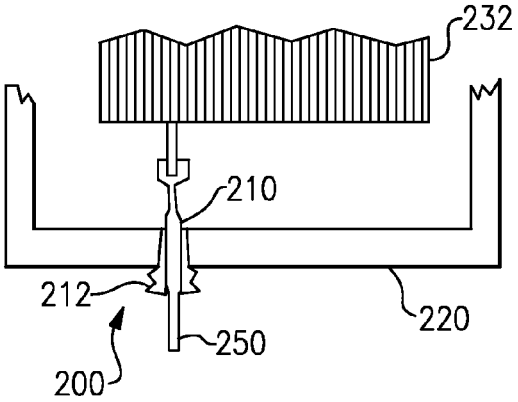
FIG. 3A is a schematic view of a connector pin used to connect conductor windings to a lead through a hermetically sealed wall.
Figure 3B:
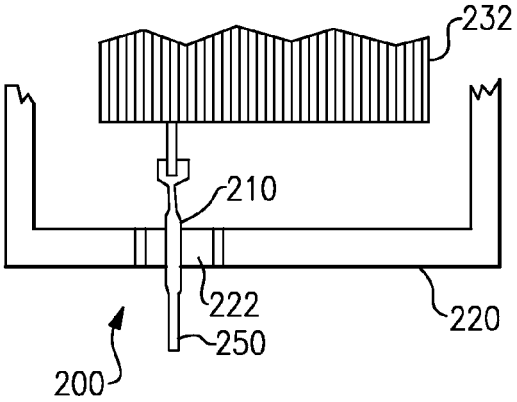
FIG. 3B is a schematic view of an alternate connector pin used to connect conductor windings to a lead through a hermetically sealed wall.

FIGS. 3A and 3B illustrate a connector 200 for connecting leads 250 to inductor windings 232. The connector 200 is a solid conductive pin 210, such as a copper pin, that extends through the housing 220 of the hermetically sealed tank 20 (illustrated in FIG. 1) and is sealed in a cast ceramic fitting 220 in the example of FIG. 3B or via a swagelock 212 in the example of FIG. 3A. The winding 232 is attached to the connector pin 210 via any known method, such as crimping or soldering. Likewise, the lead 250 is connected via a similar method.

In embodiments utilizing the connector pin 210, another alternative localized boiling feature 52 can be implemented on the surface 214 of the connector pin 210. The surface 214 of the connector pin 210 is roughened by rubbing the surface 214 with an abrasive substance prior to installation of the connector pin 210. The roughened surface 214 boils with less surface temperature overshoot and transfers more heat per unit area to the dielectric cooling liquid than a smooth surface. Therefore, the roughened surface of the connector pin 210 operates as the localized boiling feature 52. Other commercially available surface coatings and treatments, like a PBS (Porous Boiling Surface) or an organic metal powered mixture are available to enhance boiling and can be used on the localized boiling feature 52.

The increased heat flux at the connector pin 210 increases the surface 214 temperature and the surface 214 of the connector pin 210 becomes a localized boiling feature 52. This feature therefore initiates boiling before the wetted surface of the inductor windings 32. As with the localized boiling feature 52 illustrated in FIG. 1, the connector pin 210 is located below the inductor windings 32, and the boiling reaction propagates upward initiating boiling throughout the cooling liquid 60. Thus, boiling is started at the localized boiling feature 52 (the connector pin surface 214) prior to the majority of the cooling liquid 60 reaching the saturation temperature, and a temperature overshoot is prevented.

Figure 4:
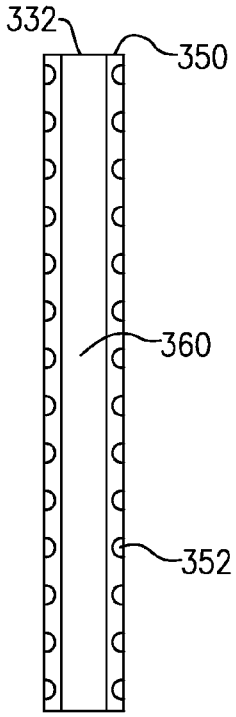
FIG. 4 illustrates an alternative localized boiling feature that can be utilized in the winding of FIG. 1.

With continued reference to FIGS. 1 and 2, FIG. 4 illustrates another alternate localized boiling feature 52 that can be utilized on one or more of the inductor windings 32, 132 illustrated in FIGS. 1 and 2. The illustrated winding 332 of FIG. 4 includes a center conductive winding 360 and an outer PBS 350. The outer PBS 350 is applied to the conductive wire 360 according to known principles. The PBS 350 includes porous features 352, very small cavities that initiate boiling, which alter the surface structure of the inductor winding 332. The relative sizes of the porous features 352, the inductor winding 332, and the PBS 350 are not to scale, and certain features are exaggerated for illustrative effect. The porous features 352 decrease the heat flux needed to incite boiling of the inductor winding 332 thereby causing a localized boiling effect along the surface of the inductor winding 332. Thus, the localized boiling feature illustrated in FIG. 4 functions in a similar manner as the smaller cross sectional localized boiling windings 152 illustrated in FIGS. 2A and 2B. By strategically placing the windings 332 including the porous boiling surface 350 throughout the inductor 30 a boiling effect can be achieved prior to oversaturation of the cooling liquid 60.

Although an example of this invention has been disclosed, a worker of ordinary skill in this art would recognize that certain modifications would come within the scope of this invention. For that reason, the following claims should be studied to determine the true scope and content of this invention.

The invention claimed is:

1. An immersion cooled inductor comprising:

a hermetically sealed immersion tank at least partially filled with a dielectric cooling liquid;

a plurality of inductor windings wound around a core, wherein said inductor windings and said core are at least partially submerged within said dielectric cooling liquid;

a plurality of leads extending from said immersion tank, wherein said leads are connected to said inductor windings; and a localized boiling winding wound about said core, said localized boiling winding including an enhanced boiling surface treatment, comprising at least one of an application of a porous boiling surface to said localized boiling winding and an application of an organic metal powdered mixture to said localized boiling winding.

2. The immersion cooled inductor of claim 1, wherein the localized boiling winding is operable to begin boiling of the dielectric cooling liquid prior to significant superheating of the cooling liquid above a saturation temperature.

3. The immersion cooled inductor of claim 1, wherein said localized boiling winding has a first cross sectional area, each of said plurality of inductor windings have a second cross sectional area, and wherein said first cross sectional area is lower than said second cross sectional area.

4. The immersion cooled inductor of claim 1 wherein said inductor windings and said core are fully submerged in said dielectric cooling liquid.

5. The immersion cooled inductor of claim 1, wherein said inductor windings are at least ¾ submerged in said dielectric cooling liquid.

6. The immersion cooled inductor of claim 1, wherein said windings are connected to said leads through a wall of said immersion tank via at least one connector pin.

7. The immersion cooled inductor of claim 6, further comprising a localized boiling feature, where the localized boiling feature is a roughened surface of said at least one connector pin, and wherein said roughened surface contacts said dielectric cooling liquid.

8. A method for cooling an inductor comprising the steps of:

at least partially submerging an inductor in a dielectric cooling liquid within a tank; and instigating boiling within said dielectric cooling liquid using a localized boiling feature, such that said dielectric cooling liquid begins boiling without exceeding a saturation temperature, wherein the localized boiling feature is one of a knee bend in a wire connecting an inductor winding to an electrical lead and a neck in a wire connecting said inductor windings to a connector pin.

9. The method of claim 8, wherein said localized boiling feature is a knee bend in a wire connecting an inductor winding to an electrical lead.

10. The method of claim 8, wherein said localized boiling feature further comprises a roughened surface of a connector pin connecting a lead to an inductor winding.

11. The method of claim 8, wherein said step of instigating boiling within said dielectric cooling liquid using a localized boiling feature comprises heating said cooling liquid around said localized boiling feature faster than said cooling liquid around said inductor, thereby initiating a boiling reaction in the cooling liquid prior to cooling liquid around said inductor exceeding a saturation temperature.

12. An immersion cooled inductor comprising:

a hermetically sealed immersion tank at least partially filled with a dielectric cooling liquid;

a plurality of inductor windings wound around a core, wherein said inductor windings and said core are at least partially submerged within said dielectric cooling liquid;

a plurality of leads extending from said immersion tank, wherein said leads are connected to said inductor windings; and a localized boiling feature, wherein the localized boiling feature is a feature of a wire connecting an inductor wire to one of a connector pin and an electrical lead.

13. The immersion cooled inductor of claim 12, wherein said localized boiling feature is a knee bend in the wire.

14. The immersion cooled inductor of claim 12, wherein said localized boiling feature is a neck in the wire.

15. The immersion cooled inductor of claim 12, wherein the localized boiling winding is operable to begin boiling of the dielectric cooling liquid prior to significant superheating of the cooling liquid above a saturation temperature.

* * * * *